US008044325B1

(12) United States Patent
Cooper

(10) Patent No.: US 8,044,325 B1
(45) Date of Patent: Oct. 25, 2011

(54) WET WIPE HEATING SYSTEM

(76) Inventor: Gloria Cooper, Essex (GB)

( * ) Notice: Subject to any disclaimer, the term of this patent is extended or adjusted under 35 U.S.C. 154(b) by 672 days.

(21) Appl. No.: 12/171,363

(22) Filed: Jul. 11, 2008

(51) Int. Cl.
*F27D 7/02* (2006.01)

(52) U.S. Cl. ..... 219/386; 219/401; 219/439; 222/146.4; 222/146.5

(58) Field of Classification Search ..... None
See application file for complete search history.

(56) References Cited

U.S. PATENT DOCUMENTS

| | | | | |
|---|---|---|---|---|
| 2,443,321 | A * | 6/1948 | Miner, Jr. | 68/5 R |
| 4,947,026 | A * | 8/1990 | Groom et al. | 219/401 |
| 5,210,396 | A | 5/1993 | Sanders | |
| 5,231,266 | A | 7/1993 | Warren | |
| D390,645 | S | 2/1998 | Hanrahan et al. | |
| 5,736,714 | A * | 4/1998 | Bechtold, Jr. | 219/521 |
| 6,639,185 | B1 * | 10/2003 | McConnell et al. | 219/386 |
| 6,674,048 | B2 * | 1/2004 | McConnell et al. | 219/385 |
| 6,847,011 | B2 * | 1/2005 | McConnell et al. | 219/386 |
| 7,022,945 | B1 | 4/2006 | Western | |
| 7,094,992 | B1 | 8/2006 | Wray et al. | |
| RE40,408 | E * | 7/2008 | McConnell et al. | 219/386 |
| 2003/0205567 | A1 * | 11/2003 | McConnell et al. | 219/385 |
| 2004/0084438 | A1 * | 5/2004 | McConnell et al. | 219/438 |

FOREIGN PATENT DOCUMENTS

JP 11225904 A * 8/1999

OTHER PUBLICATIONS

JP 11-225904, Kawait, Aug. 24, 1999, machine translation of Description.*

JP 11-225904, Kawait, Aug. 24, 1999, machine translation of Descr. of Figures.*

* cited by examiner

*Primary Examiner* — Joseph M Pelham

(57) ABSTRACT

A wet wipe heating system includes a housing that has a bottom wall and a perimeter wall. An inner compartment is positioned within the housing and includes a lower wall and a peripheral wall. The inner compartment is spaced from the housing and a receiving space having water therein is defined between the inner compartment and housing. A heat emitter is positioned within the receiving space and heats the water. A thermostat is in thermal communication with the receiving space and is electrically coupled to the heat emitter to turn the heat emitter on when the water is less than the selected temperature. A cover is hingedly coupled to the housing and is selectively positionable in an open position exposing the inner compartment or in a closed position covering the inner compartment. A plurality of wet wipes is positioned in the inner compartment and heated by the water.

6 Claims, 6 Drawing Sheets

WET WIPE HEATING SYSTEM

BACKGROUND OF THE INVENTION

Field of the Invention

The present invention relates to wet wipe heating devices and more particularly pertains to a new wet wipe heating device for heating wet wipes used for cleaning an infant or toddler during diaper changes so that the wet wipes are warm to provide soothing comfort to the infant or toddler.

SUMMARY OF THE INVENTION

The present invention meets the needs presented above by generally comprising a housing that has a bottom wall and a perimeter wall that is attached to and extending upwardly from the bottom wall. An inner compartment is positioned within the housing and includes a lower wall and a peripheral wall that is attached to and extends upwardly from the lower wall. The peripheral wall has an upper edge and a peripheral flange is attached to and is coextensive with the upper edge of the peripheral wall and a top edge of the perimeter wall. The inner compartment is spaced from the housing and a receiving space is defined between the perimeter and peripheral walls and between the bottom and lower walls. The perimeter wall has a fill conduit extending therethrough and is fluidly coupled to the receiving space. A heat emitter is positioned within the receiving space. A quantity of water is poured into the receiving space through the fill conduit and is heated by the heat emitter. A thermostat is in thermal communication with the receiving space and measures a temperature of the water. The thermostat is electrically coupled to the heat emitter and turns off the heat emitter when the water has attained a selected temperature and turns the heat emitter on when the water is less than the selected temperature. A cover is hingedly coupled to the housing and is selectively positionable in an open position exposing the inner compartment or in a closed position covering the inner compartment. A plurality of wet wipes is positioned in the inner compartment and heated by the water.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
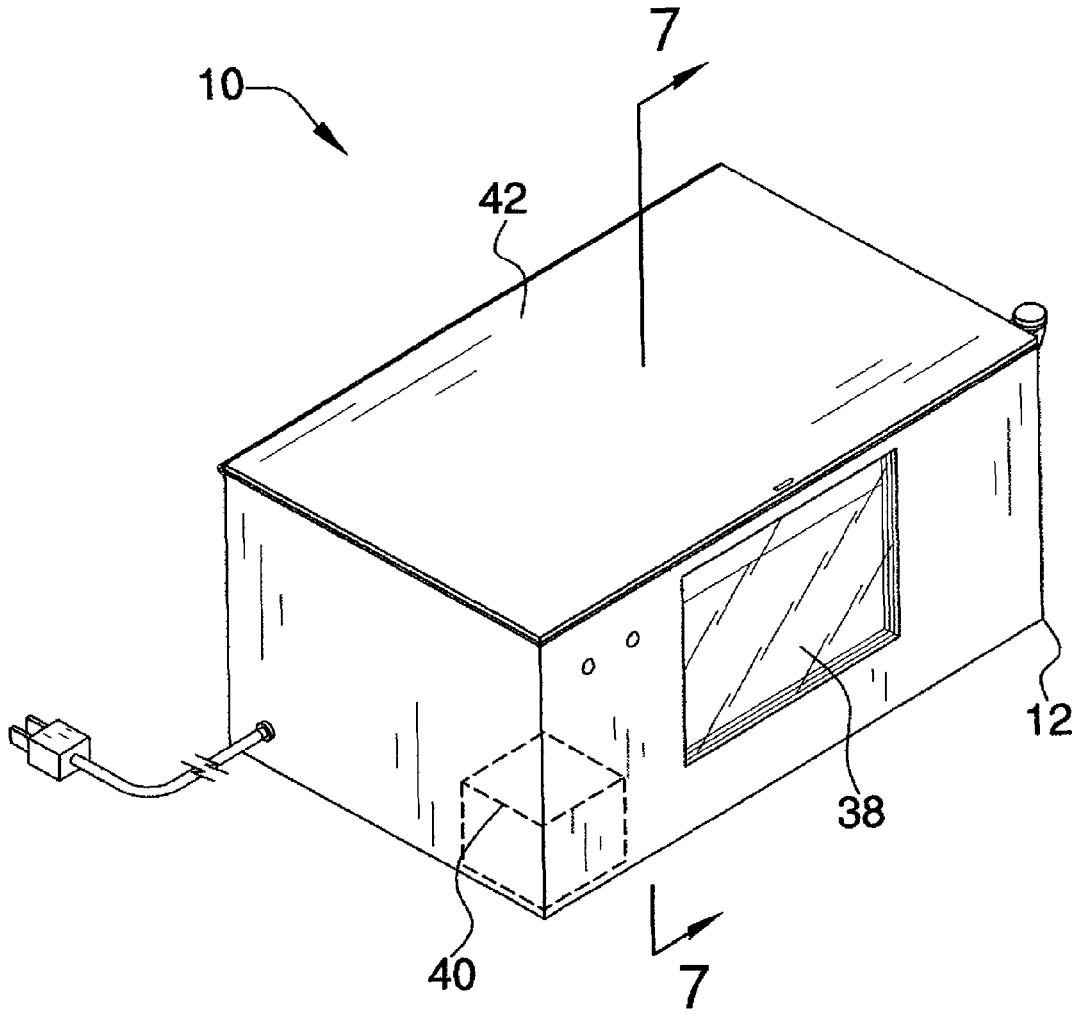
FIG. 1 is a top perspective view of a wet wipe heating system according to the present invention.

With reference now to the drawings, and in particular to FIGS. 1 through 8 thereof, a new wet wipe heating device embodying the principles and concepts of the present invention and generally designated by the reference numeral 10 will be described.

As best illustrated in FIGS. 1 through 8, the wet wipe heating system 10 generally comprises a housing 12 that has a bottom wall 14 and a perimeter wall 16 is attached to and extends upwardly from the bottom wall 14. An inner compartment 18 is positioned within the housing 12 and includes a lower wall 20 and a peripheral wall 22 that is attached to and extends upwardly from the lower wall 20. The peripheral wall 22 has an upper edge 24 and a peripheral flange 26 is attached to and is coextensive with the upper edge 25 of the peripheral wall 22 and a top edge 28 of the perimeter wall 16. The inner compartment 18 is spaced from the housing 12 and a receiving space 28 is defined between the perimeter 16 and peripheral 22 walls and between the bottom 14 and lower 20 walls. The perimeter wall 16 has a fill conduit 30 extending therethrough and is fluidly coupled to the receiving space 28. A cap 32 is removably positionable over the fill conduit 30 to close the fill conduit 30.

A heat emitter 34 is positioned within the receiving space 28 and is positioned between the lower 20 and bottom 14 walls. The heat emitter 34 may include one or more conventional heating elements used for heating water. A quantity of water 36 is poured into the receiving space 28 through the fill conduit 30 and the heat emitter 34 heats the water. A window 38 is positioned in the perimeter wall 16 to view a level of the water 36 in the receiving space.

A thermostat 40 is in thermal communication with the receiving space 28 and measures a temperature of the water. The thermostat 40 is electrically coupled to the heat emitter 34. The thermostat 40 turns off the heat emitter 34 when the water has attained a selected temperature and turns the heat emitter 34 on when the water is less than the selected temperature. The selected temperature is between 33° C. and 41° C. and may be 37° C. to match a human's body temperature.

A cover 42 is hingedly coupled to the housing 12 and is selectively positionable in an open position exposing the inner compartment 18 or in a closed position covering the inner compartment 18. A locking member 44 engages the cover 42 when the cover 42 is in the closed position to releasably secure the cover 42 in the closed position. The locking member 44 is attached to the peripheral flange 26 and snaps into a receiving aperture 46 in the cover. A gasket member 48 is positioned on an upper surface of the peripheral flange 26 to provide an approximately airtight closure of the inner compartment 18 when the cover 42 abuts the gasket member 48 when the cover 42 in the closed position. The gasket member 48 is coextensive with the peripheral flange 26.

Figure 2:
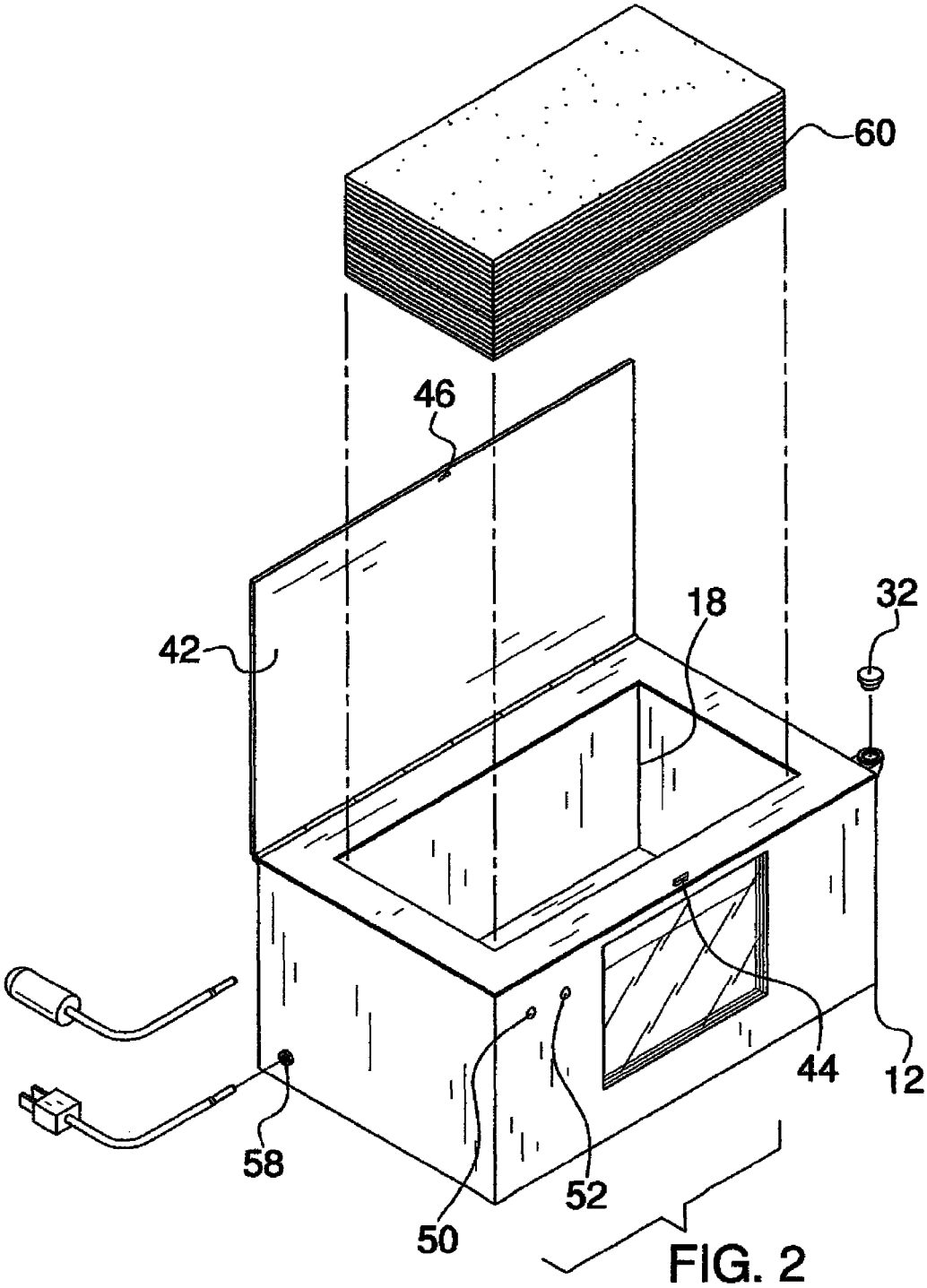
FIG. 2 is a top perspective view of the present invention.
Figure 3:
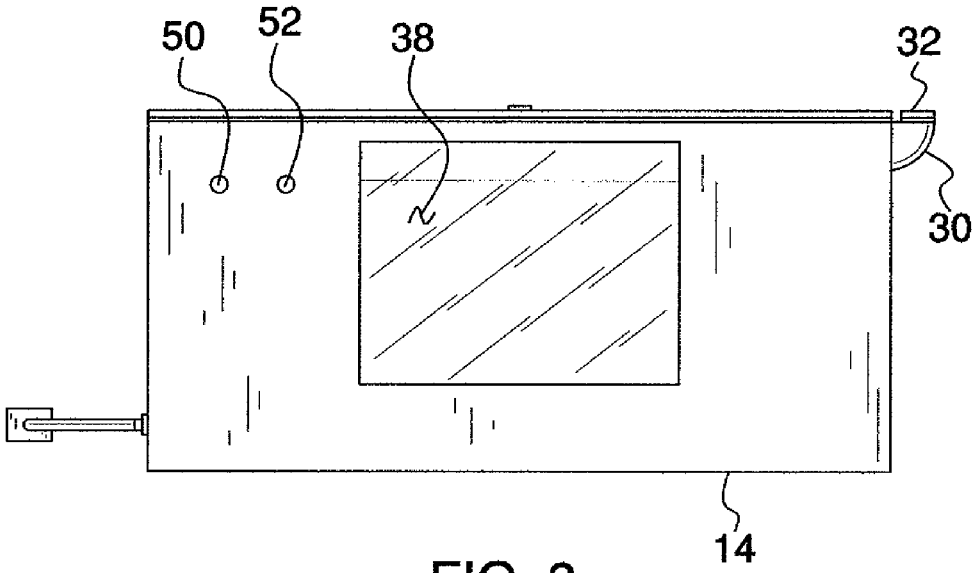
FIG. 3 is a front view of the present invention.
Figure 4:
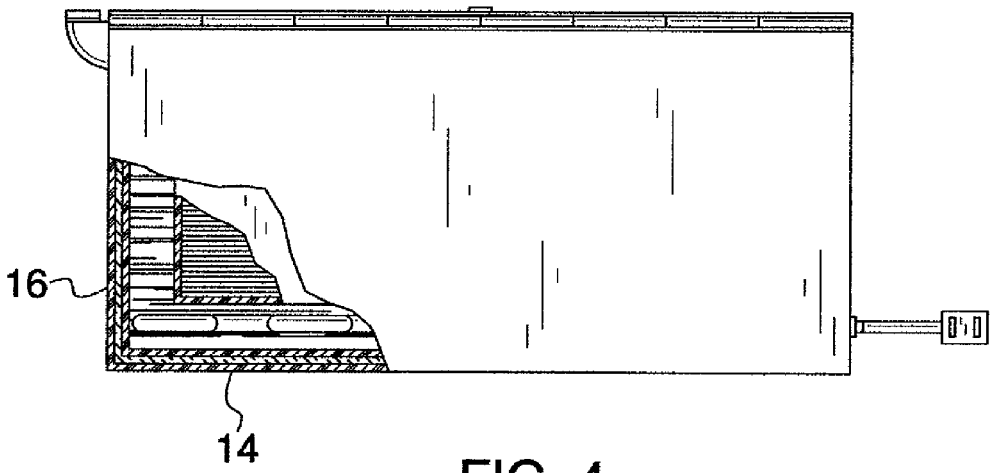
FIG. 4 is a broken rear view of the present invention.
Figure 5:
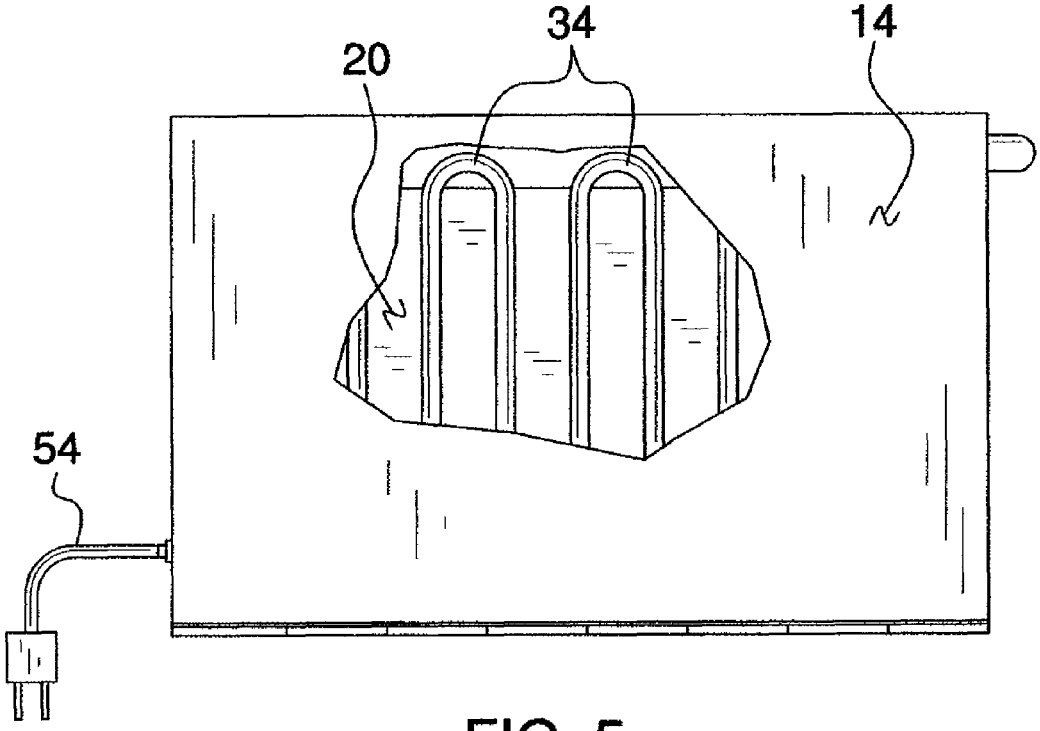
FIG. 5 is a broken bottom view of the present invention.
Figure 6:
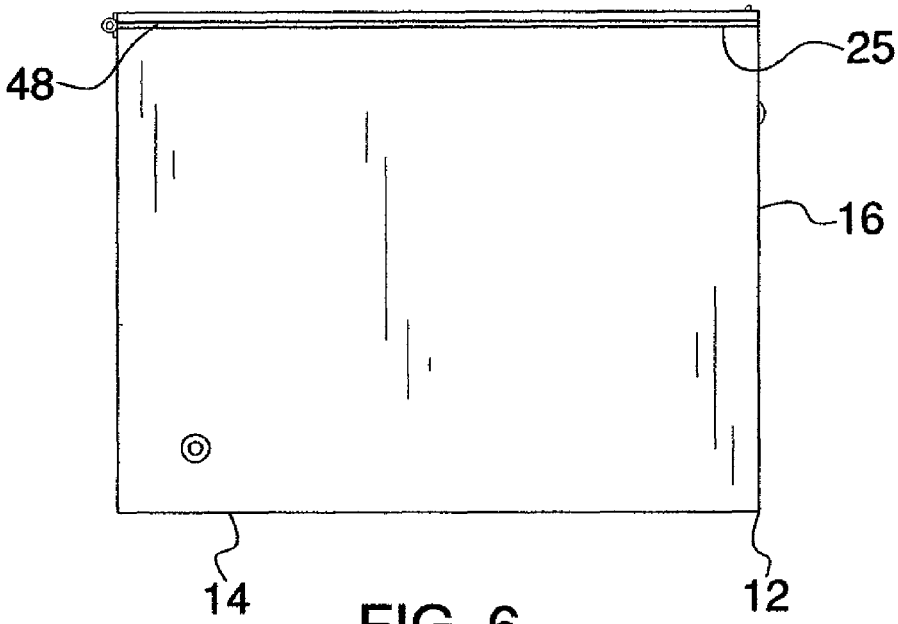
FIG. 6 is a side view of the present invention.
Figure 7:
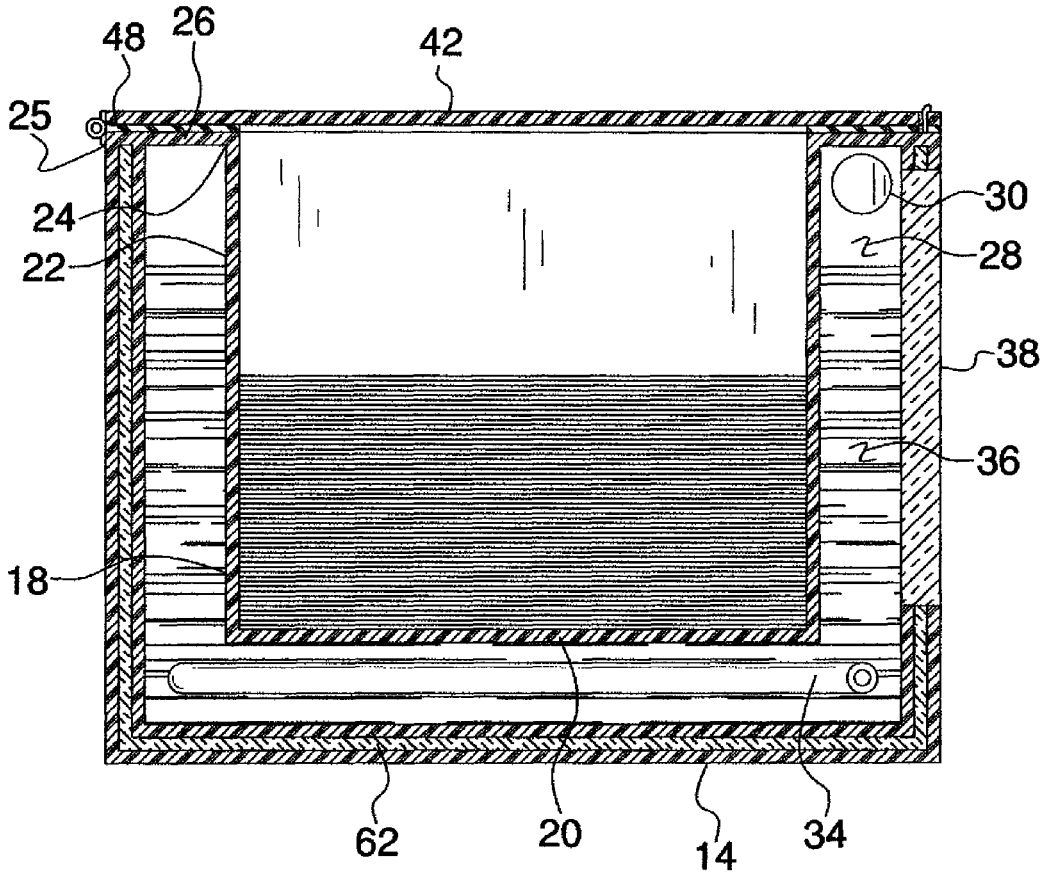
FIG. 7 is a cross-sectional view of the present invention taken along line 7-7 of FIG. 1.
Figure 8:
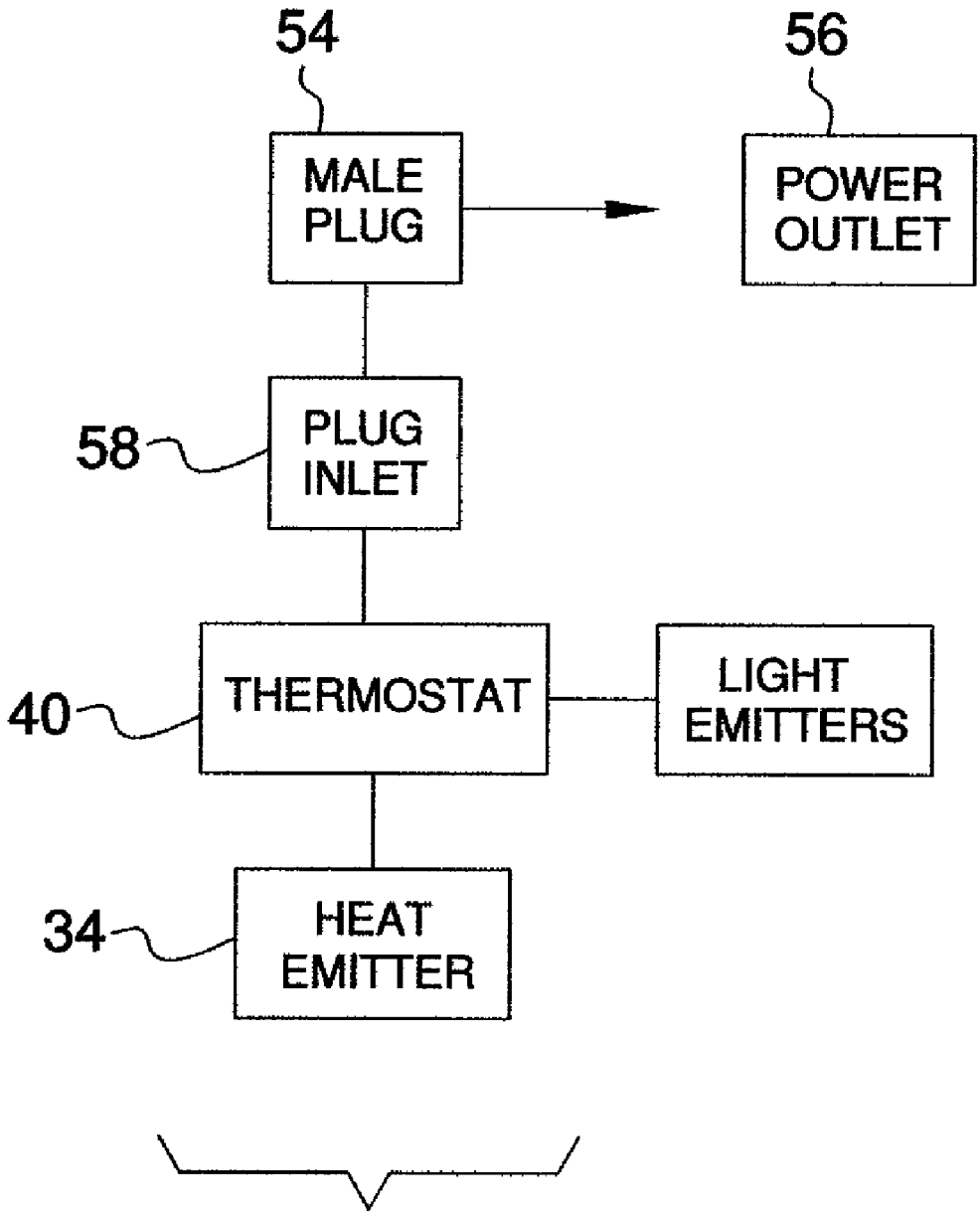
FIG. 8 is a schematic view of the present invention.

A light emitter 50 is mounted on the housing 12 and is electrically coupled to the thermostat 40. The light emitter 50 emits light when the heat emitter 34 is turned on by the thermostat 40. A second light emitter 52 may be used to signal that the heat emitter 34 is turned off. A power cord 54 is electrically coupled to the thermostat 40 and can be plugged into an electrical outlet 56 to supply power to the thermostat 40, light emitters 50, 52 and the heat emitter 34. The power cord 54 may be pluggable into a plug inlet 58 electrically coupled to the thermostat 40 to allow different types of male power plugs, as shown in FIG. 2, to be electrically coupled to the thermostat.

In use, a plurality of conventional wet wipes 60, or fluid saturated cloths of paper or synthetic material, is positioned in the inner compartment and heated by the water 36. The thermostat 40 ensures that the water 36 will not become overly warm while providing a medium which will remain warm for long time durations. The bottom 14 and perimeter 16 walls may include insulating material 62 to further retain the water in a warm 36 state for a longer period of time.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wet wipe heating system comprising:

a housing having a bottom wall and a perimeter wall being attached to and extending upwardly from said bottom wall;

an inner compartment being positioned within said housing and including a lower wall and a peripheral wall being attached to and extending upwardly from said lower wall, said peripheral wall having an upper edge, a peripheral flange being attached to and being coextensive with said upper edge of said peripheral wall and a top edge of said perimeter wall, said inner compartment being spaced from said housing and a receiving space being defined between said perimeter and peripheral walls and between said bottom and lower walls, said perimeter wall having a fill conduit extending therethrough and being fluidly coupled to said receiving space;

a heat emitter being positioned within said receiving space, said heat emitter being positioned between said lower and bottom walls;

a quantity of water being poured into said receiving space through said fill conduit, said heat emitter heating said water;

a thermostat being in thermal communication with said receiving space and measuring a temperature of the water, said thermostat being electrically coupled to said heat emitter, said thermostat turning off said heat emitter when said water has attained a selected temperature and turning said heat emitter on when said water is less than the selected temperature;

a cover being hingedly coupled to said housing and being selectively positionable in an open position exposing said inner compartment or in a closed position covering said inner compartment;

a gasket member being positioned on an upper surface of said peripheral flange to provide an approximately airtight closure of said inner compartment when said cover abuts said gasket member when said cover in said closed position; and wherein a plurality of wet wipes is positioned in said inner compartment and heated by the water.

2. The system according to claim 1, wherein said selected temperature is between 33° C. and 41° C.

3. The system according to claim 1, further including a locking member engaging said cover when said cover is in said closed position to releasably secure said cover in said closed position.

4. The system according to claim 1, further including a window being positioned in said perimeter wall to view a water level of the water in the receiving space.

5. The system according to claim 1, further including a light emitter being mounted on said housing and being electrically coupled to said thermostat, said light emitter emitting light when said heat emitter is turned on by said thermostat.

6. A wet wipe heating system comprising:

a housing having a bottom wall and a perimeter wall being attached to and extending upwardly from said bottom wall;

an inner compartment being positioned within said housing and including a lower wall and a peripheral wall being attached to and extending upwardly from said lower wall, said peripheral wall having an upper edge, a peripheral flange being attached to and being coextensive with said upper edge of said peripheral wall and a top edge of said perimeter wall, said inner compartment being spaced from said housing and a receiving space being defined between said perimeter and peripheral walls and between said bottom and lower walls, said perimeter wall having a fill conduit extending therethrough and being fluidly coupled to said receiving space;

a heat emitter being positioned within said receiving space, said heat emitter being positioned between said lower and bottom walls;

a quantity of water being poured into said receiving space through said fill conduit, said heat emitter heating said water;

a thermostat being in thermal communication with said receiving space and measuring a temperature of the water, said thermostat being electrically coupled to said heat emitter, said thermostat turning off said heat emitter when said water has attained a selected temperature and turning said heat emitter on when said water is less than the selected temperature, said selected temperature being between 33° C. and 41° C.;

a cover being hingedly coupled to said housing and being selectively positionable in an open position exposing said inner compartment or in a closed position covering said inner compartment, a locking member engaging said cover when said cover is in said closed position to releasably secure said cover in said closed position;

a gasket member being positioned on an upper surface of said peripheral flange to provide an approximately airtight closure of said inner compartment when said cover abuts said gasket member when said cover in said closed position;

a light emitter being mounted on said housing and being electrically coupled to said thermostat, said light emitter emitting light when said heat emitter is turned on by said thermostat;

a window being positioned in said perimeter wall to view a water level of the water in the receiving space; and wherein a plurality of wet wipes is positioned in said inner compartment and heated by the water.

* * * * *